US009721546B2

(12) United States Patent
Laukat et al.

(10) Patent No.: US 9,721,546 B2
(45) Date of Patent: Aug. 1, 2017

(54) MUSICAL INSTRUMENT VIBRATIONAL ENERGY MODIFICATION APPARATUS AND SYSTEM

(71) Applicant: Cannonball Musical Instruments, Sandy, UT (US)

(72) Inventors: Sheryl Laukat, Sandy, UT (US); Tevis Laukat, Sandy, UT (US); Ryan Laukat, Cottonwood Heights, UT (US); Ryan Lillywhite, Sandy, UT (US); Randal Clark, Herriman, UT (US); Howard Summers, Lehi, UT (US)

( * ) Notice: Subject to any disclaimer, the term of this patent is extended or adjusted under 35 U.S.C. 154(b) by 0 days.

(21) Appl. No.: 14/631,605

(22) Filed: Feb. 25, 2015

(65) Prior Publication Data

US 2015/0243265 A1 Aug. 27, 2015

Related U.S. Application Data

(60) Provisional application No. 61/944,423, filed on Feb. 25, 2014.

(51) Int. Cl.

| | |
|---|---|
| ***G10D 9/00*** | (2006.01) |
| ***G10D 9/02*** | (2006.01) |
| ***G10D 7/00*** | (2006.01) |
| ***G10D 7/08*** | (2006.01) |
| ***G10D 7/10*** | (2006.01) |

(52) U.S. Cl.

CPC ..... *G10D 9/00* (2013.01); *G10D 7/00* (2013.01); *G10D 7/08* (2013.01); *G10D 7/10* (2013.01); *G10D 9/005* (2013.01); *G10D 9/02* (2013.01)

(58) Field of Classification Search

CPC G10D 9/00; G10D 9/02; G10D 9/005; G10D 7/00; G10D 7/08; G10D 7/10

USPC ..... 84/380 R, 330, 398, 385 R, 387 R

See application file for complete search history.

(56) References Cited

U.S. PATENT DOCUMENTS

| | | | | | |
|---|---|---|---|---|---|
| 1,555,986 | A | * | 10/1925 | Keefer, Jr. | G10D 9/005 84/396 |
| 1,744,519 | A | * | 1/1930 | Blessing | G10D 9/005 261/114.1 |
| 2,146,967 | A | * | 2/1939 | Loomis | G10D 9/005 84/394 |
| 2,232,151 | A | * | 2/1941 | Trew | G10D 7/08 84/170 |
| 2,971,423 | A | * | 2/1961 | LeBlanc | G10D 7/00 84/380 R |

(Continued)

*Primary Examiner* — David Warren
*Assistant Examiner* — Christina Schreiber
(74) *Attorney, Agent, or Firm* — Scarinci Hollenbeck

(57) ABSTRACT

A musical wind instrument, comprising a mouthpiece, key mechanism, body, and an alternative material bridge that is couple a first and second opposite facing tube. There is in an alternative embodiment at least one coupling mechanism affixed to at least one of the opposite facing tubes designed to releasably hold the wood based material bridge against the first and second tubes. Alternatively there is a musical wind instrument made of a predominantly first material, comprising a mouthpiece, key mechanism, and body; at least a first and second tube having a portion thereof being spatially opposite to each other respectively, and a bridge, having a first and second end that are coupled to the first and second tube respectively, wherein the bridge is made of an alternative material that is different from the predominantly first material of the instrument.

12 Claims, 7 Drawing Sheets

(56) References Cited

U.S. PATENT DOCUMENTS 3,529,505 A * 9/1970 Brooks ..... G10D 7/10 84/387 R
4,341,146 A * 7/1982 Massa ..... G10D 15/00 84/381
4,831,911 A * 5/1989 Wanner ..... G10D 7/10 84/395
4,977,809 A * 12/1990 Staley, Jr. ..... G10D 7/10 84/395
5,644,095 A * 7/1997 Davidson ..... G10D 9/00 84/387 R
5,656,788 A * 8/1997 Wise ..... G10D 7/10 84/387 A
5,834,666 A * 11/1998 Wanner ..... G10D 7/10 84/395
5,894,098 A * 4/1999 Hsieh ..... G10D 7/10 84/387 A
5,965,832 A * 10/1999 Davidson ..... G10D 9/00 84/387 R
6,717,041 B1 * 4/2004 Hilliard ..... G10D 7/10 84/394
6,794,564 B2 * 9/2004 Louis ..... G10D 7/06 84/380 R
7,335,831 B2 * 2/2008 Laukat ..... G10D 7/10 84/387 R
7,439,429 B2 * 10/2008 Wood ..... G10D 7/00 84/385 R
7,468,479 B2 * 12/2008 Kraus ..... G10D 9/043 84/385 P
8,227,676 B2 * 7/2012 Jackson ..... G10D 7/10 84/380 R
8,247,675 B2 * 8/2012 Griego ..... G10D 7/10 84/387 R
8,278,540 B1 * 10/2012 Chen ..... G10D 7/10 84/387 R
8,907,189 B2 * 12/2014 Bernacki ..... G10G 5/00 84/380 R
2002/0139237 A1 * 10/2002 Momchilovich ..... G10D 3/16 84/400
2009/0020000 A1 * 1/2009 Onozawa ..... G10D 7/00 84/723
2012/0024127 A1 * 2/2012 Rashleigh ..... G10D 7/10 84/396
2015/0243265 A1 * 8/2015 Laukat ..... G10D 9/00 84/380 R

* cited by examiner

MUSICAL INSTRUMENT VIBRATIONAL ENERGY MODIFICATION APPARATUS AND SYSTEM

CROSS REFERENCE TO RELATED APPLICATION[S]

This application claims priority to U.S. Provisional Patent Application entitled "MUSICAL INSTRUMENT VIBRATIONAL ENERGY MODIFICATION APPARATUS AND SYSTEM," Ser. No. 61/944,423, filed Feb. 25, 2014, now pending, the disclosure of which is hereby incorporated entirely herein by reference.

BACKGROUND OF THE INVENTION

Technical Field

The present disclosure is directed to a musical instrument and method for a personal to create music. More specifically, there is an apparatus and method for modifying the sounds or sound energy on known instruments, like a saxophone, by replacing the support connecting struts with different material, like wood, stone, plastic, polymers or any other material not making up the majority of the subject instrument, in the instrument as disclosed in the specification of the invention and related claims.

State of the Art

It is well known to in the art how to create sounds on wind instruments, like saxophones and such. It is also well known in the art to provide a mouth piece and instrument body, with keys coupled thereto that are used to modify the sound energy to create various tones. The following patents are provided as examples of such known art, and are herein incorporated by reference for their supporting teachings to the disclosed invention, whereby:

U.S. Pat. No. 7,335,831 B2, by Laukat, issued in 2008, teaches of placing hard material on selected spots outside the tubing of wind instruments to affect the vibrational energy of the musical instrument.

U.S. Pat. No. 7,439,429, by Wood al., issued Oct. 21, 2008, is a wind instrument with improved tonal characteristics by positioning an octave hole, an octave key mechanism, and a water key on a surface of the wind instrument that is not a tone rich region.

US Patent App. 2004/0003702 to Ahrens, pub. Date of Jan. 8, 2004, is a flute comprising first and second chambers in which sound is resonated and a tone hole disposed at and shared by the first and second chambers.

U.S. Pat. No. 4,341,146 to Massa, issued Jul. 27, 1982, is a musical instrument combining a modified portion of a tenor saxophone with a modified portion of a soprano saxophone joined together by means of a bracket whereby one of the two instruments can be moved relative to the other to obtain proper alignment.

U.S. Pat. No. 6,476,302, on Nov. 5, 2002, to Liu, is a saxophone with a main body, a neck, a treble connection set, a connection rod, and a link set.

US Patent App. 2005/0217464, to Onozawa et al., pub. Data of Oct. 6, 2005, is a hybrid saxophone whit the combination of an acoustic saxophone and an electronic system, and the electronic system includes key sensors for monitoring the keys and a tonguing sensor for detecting the position of the tongue together with a breath sensor and a lip sensor.

U.S. Pat. No. 4,320,686, to Lewis, issued Mar. 23, 1982, is a wind instrument having a mouthpiece connected to the inner end of a tube forming an elongated resonating chamber.

U.S. Pat. No. 1,555,986, to Keefer, issued Oct. 6, 1925, teaches of a tuning device for musical wind instrument.

U.S. Pat. No. 2,033,774, to Loomis, issued 1936, teaches of new saxophone design.

U.S. Pat. No. 2,474,336, to Gillespy, issued in 1945, teaches of a new saxophone design.

U.S. Pat. No. 2,971,423, to LaBlanc, issued in 1961, teaches of a new saxophone bridge design.

U.S. Pat. No. 5,644,095, to Davidson, issued in 1997, teaches of a new dampening wedge material made of a polymeric material used in wind musical instruments to dampen the vibrational energy in the instrument by placing the polymeric material between opposing tubes of the instrument.

None of these prior art patents or applications teaches the disclosed invention either singly or in combination. What is needed in the art of musical instruments is an instrument or technique to modify, affect, alter, impact or adjust a wind instrument's vibrational energy or sound energy for certain tones that are created by the instrument at the manufacturing stage, after the initial manufacturing stage, by the musician, or in a time other than during the active playing of the instrument, which is typically only controlled by the keys and mouthpiece of the instrument. Additionally, there is a need for an instrument that has a design or a method for a person to be able to affect, alter, modify or impact the permanent sound or vibrational characteristics of the whole instrument musical range, or selected portions thereof

SUMMARY

The present invention has been developed in response to the present state of the art, and in particular, in response to the problems and needs in the art that have not yet been fully solved by currently available containers and lotions. Accordingly, the present invention has been developed to provide a musical instrument and/or a manufacturing method or adjustment technique to modify, affect, alter, impact or adjust a wind instrument's vibrational energy or sound energy for certain tones that are created by the instrument at or after the manufacturing stage or in a time other than during the active playing of the instrument, by the musician, which is typically only controlled by the keys and mouthpiece of the instrument. Additionally, there is provided a device that has or method for a person to be able to affect, alter, modify or impact the permanent sound or vibrational characteristics of at least a portion of the instrument musical range. More specifically, there is an apparatus and method for modifying the sounds or sound energy on known instruments, like a saxophone, by replacing the support connecting struts with different material, like wood, stone, plastic, polymers or any other material not making up the majority of the subject instrument, in the instrument as disclosed in the specification of the invention.

Reference throughout this specification to features, advantages, or similar language does not imply that all of the features advantages that may be realized with the present invention should be or are in any single embodiment or the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

Figure 1:
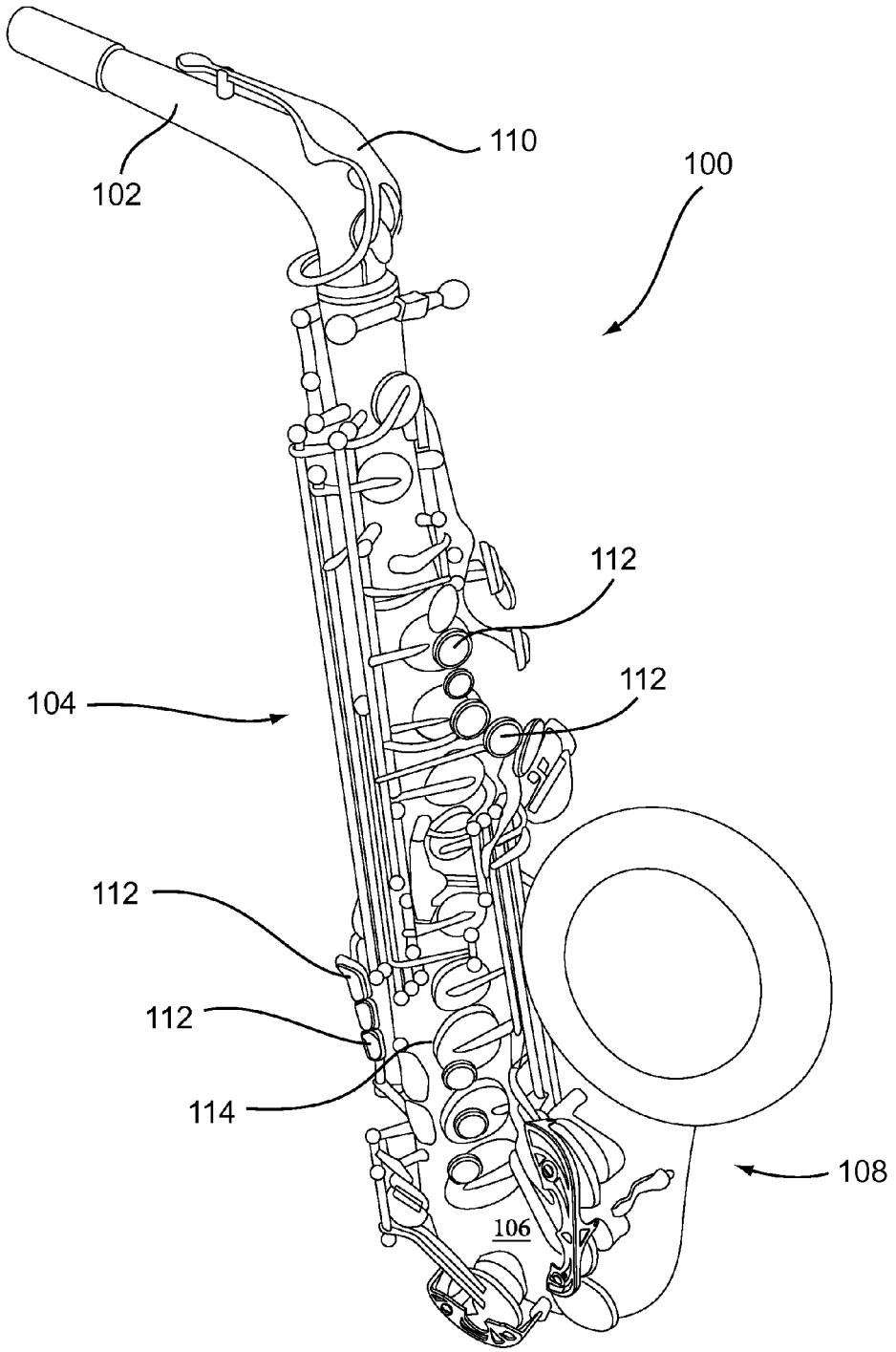
FIG. 1 is a perspective view of an alto saxophone.
Figure 2:
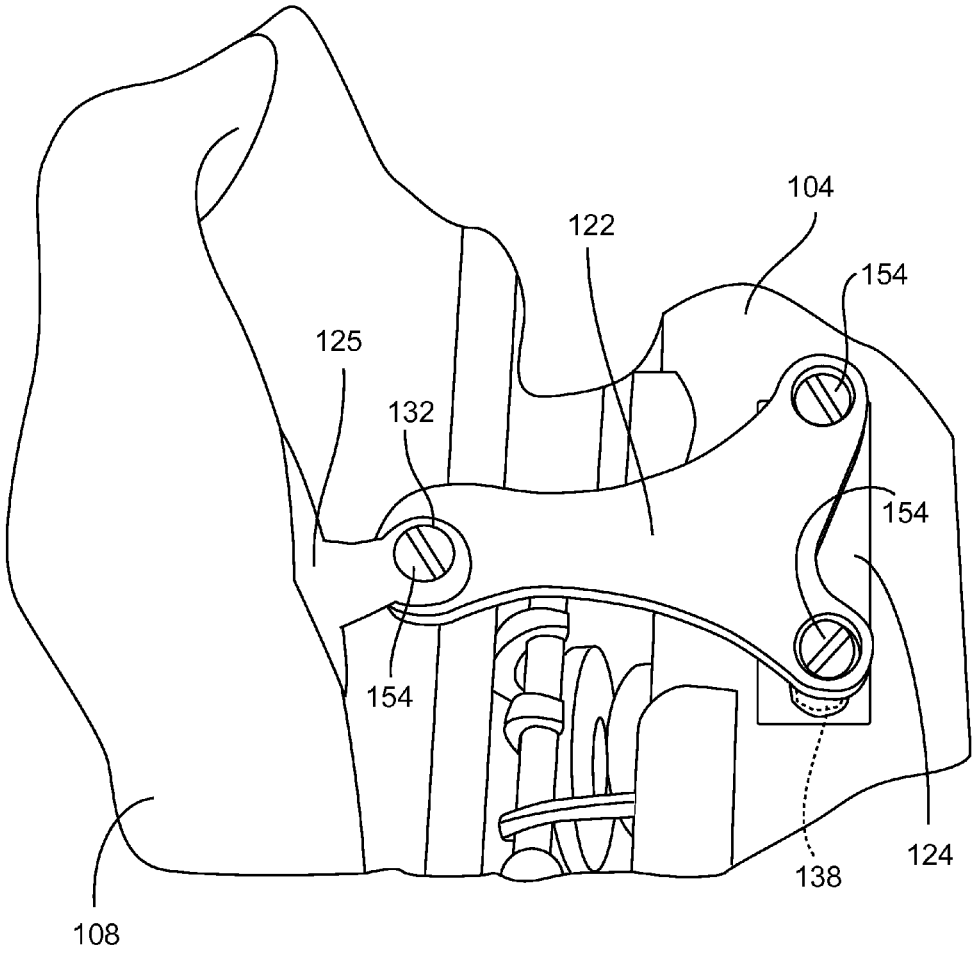
FIG. 2 is a partial perspective view of an instrument with a brace coupled thereto.
Figure 3:
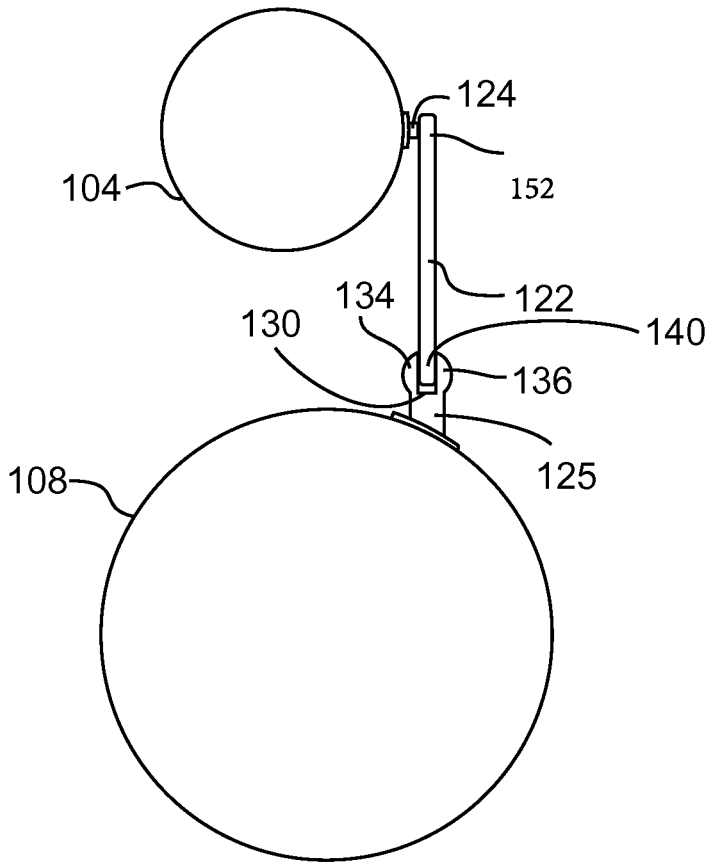
FIG. 3 is a top diagrammatical view of an instrument with a brace coupled thereto.
Figure 4:
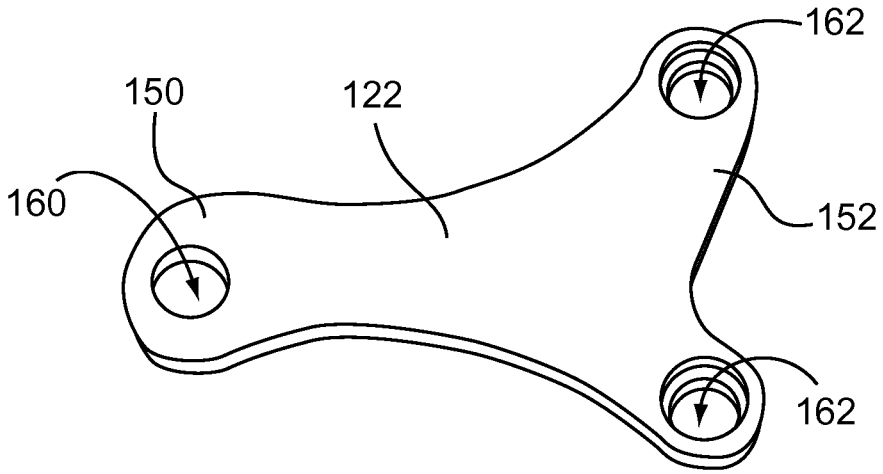
FIG. 4 is a perspective view of a brace.

For the purposes of promoting an understanding of the principles of the invention, reference will now be made to the exemplary embodiment. Wherein, each statement of an embodiment is to be considered independent or any other embodiment, despite any use of similar or identical language.

Reference throughout this specification to "one embodiment," "an embodiment," or similar language means that a particular feature, structure, or characteristic described in connection with the embodiment is included in at least one embodiment of the present invention. Thus, appearances of the phrases "one embodiment," "an embodiment," and similar language throughout this specification may, but do not necessarily, all refer to the same embodiment, different embodiments, or component parts of the same or different illustrated invention. Additionally, reference to the wording "an embodiment," or the like, for two or more features, elements, etc. does not mean that the features are related, dissimilar, the same, etc. The use of the term "an embodiment," or similar wording, is merely a convenient phrase to indicate optional features, which may or may not be part of the invention as claimed.

As used herein, "tonal characteristics" includes any of the characteristics such as timbre, pitch, tonal consistency, evenness, tone quality, focus, clarity, character, warmth, centering, and/or depth of sound.

As used herein, "body" includes any part of the wind instrument used for the generation of sound, or the surface along which, or through which, the sound resonates and/or travels. That is, the body will include the structure through which the forced air and/or sound vibrations flow. The body may include, for example, the mouthpiece, the neck, the body tube, the valve(s), the bell, the bow, and the like. For example, if the woodwind instrument is a saxophone, the body of the instrument includes the reed, neck, body tube, bow, bridge/brace, and bell.

As used herein, "key mechanism" includes the key and the pieces that are coupled to, or function with the key to facilitate the opening and/or closing of a tone hole.

As used herein, "water key" includes any water key such as, for example, spit valves, amatos, and the like.

As used herein, "wind instrument" includes any instrument in which column of air is put into vibration by a player blowing into or over a mouthpiece. Wind instruments include, for example, woodwinds and brass instruments.

As used herein, "woodwind instrument" is conserved to be part of the wind instrument family, and includes any instrument in which sound is produced by blowing through a mouthpiece against an edge or a vibrating reed. The pitch may be varied by opening or closing the holes in the body of the instrument. "Woodwind instrument" is a class definition, and does not necessarily restrict the class to instruments made of wood. As such, woodwind instruments may be constructed of any material suitable for construction of a wind instrument. Some examples of woodwind instruments include: single reed woodwinds such as arghul, aulochrome, basset horn, clarinet, E-flat clarinet, alto clarinet, bass clarinet, contra-alto clarinet, contrabass clarinet, launeddas, mijwiz, rothphone, sarrusophone, saxophone, soprillo, sopranino saxophone, soprano saxophone, alto saxophone, tenor saxophone, C melody saxophone, baritone saxophone, bass saxophone, contrabass saxophone, subcontrabass saxophone, tubax, tarogato and the like; double-reed woodwinds such as bassanelli, bassoon, contrabassoon, bombarde, duduk, dulcian, dulzania, guan, heckelphone, piccolo heckelphone, hojok, mizmar, nadaswaram, oboe, piccolo oboe, oboe d'amore, English horn, oboe da caccia, racket, shawm, shehnai, suona, surnay, tromboon, trompeta china, zurna, bagpipes, cornamuse, crumhorn, hirtenschalmei, kortholt, rauschpfeife, and the like; and flutes such as bansuri, flute, fife, piccolo, Western concert flute, alto flute, bass flute, contrabass flute, ryuteki, hocchiku, kaval, ney, quena, shakuhachi, flageolet, gemshorn, ocarina, recorder, tin whistle, penny whistle, tonette, and the like.

As used herein, "brass instrument" is considered part of the wind instrument family, and includes any instrument in which sound is produced by vibration of the lips as the player blows into a resonator, and are thus also known as labrosones. Brass instruments have various general ways of varying the tone. In one class of brass instruments, the tone is varied only by increasing or decreasing the rate of vibrations of the lips. In such instruments, the only available tones are those in the harmonic series of the instrument. On example of such an instrument is the bugle. In a third class of brass instruments, the tone may be varied by changing the length of the tubing using a slide. One example of such an instrument is the trombone. In yet another class of brass instruments, the tone may be varied by covering and/or uncovering holes along the body of the instrument. One example of such an instrument is the cornetto. Brass instrument may also vary tone by using a combination of the above techniques. "Brass instrument" is a class definition, and does not necessarily restrict the class to instruments made of brass. As such, brass instruments may be constructed of any material suitable for construction of a wind instrument. Some examples of brass instruments include: trumpets, bass trumpets, flumpets, French horns, tubas, Wagner tubas, trombones, superbones, bugles, sousaphones, mellophones, euphoniums, flugelhorns, saxhorns, cornets, cornetto, serpents, sackbuts, bazookas, horns, ophicleides, didgeridoos, shofars, conches, alphorns, cimbassos, keyed trumpets, and the like.

As used herein, "region" is interchangeable with "surface" when indicating a concave surface, tone-rich region, convex surface, non tone-rich region, and the like.

Finally, the fact that the wording "an embodiment," or the like, does not appear at the beginning of every sentence in the specification, such as is the practice of some practitioners, is merely a convenience for the reader's clarity. However, it is the intention of this application to incorporate by reference the phrasing "an embodiment," and the like, at the beginning of every sentence herein where logically possible and appropriate.

FIG. 1 illustrates a side perspective view of a woodwind instrument according to one embodiment of the present invention. In this illustration, the woodwind instrument is a saxophone 100, specifically, an alto saxophone. The Wood Wind instrument includes a neck 102, a body tube 104, a bow 106, and a bell 108. Along the body tube 104, bow 106 and bell 108, there may be at least one tone hole 114. At least one octave key 110 may also be provided. At least one key 112 may also be provided. The key 112 may be configured to control the opening and/or closing of the tone hole 114 when depressed. The keys 112 may be linked to tone hole covers through a key mechanism. In one embodiment, the tone holes 114 may be biased in the closed or open position, and the keys 112, when depressed, may be configured to open the tone holes 114 that are biased in a closed position, and/or close the tone holes 114 that are biased in an open position. There may be a series of tone holes 114 and keys 112. The series of tone holes 114 and keys 112 may be configured such that the depressing of keys 112 opens certain of the tone hole covers. For example, the low B and low B flat tone holes may be biased in an open position. Conversely, the low C sharp tone hole may be biased in a closed position.

In FIGS. 2-5, there is an illustration of a saxophone portion with the invention mounted thereto. This saxophone 100 represent one embodiment of the wind instrument family, and is used to illustrate the application of the invention as it is applied to the representative saxophone. Wherein, it is understood by those skilled in the art of musical wind instrument design and fabrication that any wind instrument can used to illustrate the embodiments of the invention as described herein. Specifically, in this embodiment, there is illustrated the use of at least one brace 122 coupled between tubes 104 and 108 being spatially opposite each other, such as, but not limited to, having relatively opposing parallel traversing positions. Uniquely, the brace/bridge 122 may be made of any non-brass based material, such as wood material or wood-based, cellulose-based, fibrous-based, non-metallic material, in addition it is contemplated to use: any plastic, all known polymers, any synthetic, all composite materials, any stone, all precious stone, or any other known material that does not make up the largest portion of the musical instrument, typically being brass or brass alloys. However, in this embodiment, any type of previously known musical wind instrument material may be used for the tubes for the application of the present invention.

Referring now to construction of the bridge 122 of the invention, it has been discovered by the present inventors, that prior art designs of the bridge have been made of a metallic material, which has typically matched the same material that the majority of the instrument has been made of; that being the previously referred to brass and its alloys. Such metallic material bridges have certain vibrational energy rigidity as to cause certain restrictions in the acoustic energy created by the playing of the instrument.

Thereby, by replacing the traditional metallic based material bridge with that of a different material, like a more resilient soft absorbing wood based material, there would be a notable affect to the overall tone of the wind instrument that is desirous to the listener.

The following is a list of known softwoods and hardwoods that are considered included embodiments of the wood based bridge/brace 122 that are intended to be incorporated in the design of the described wind instrument. In particular, the woods intended to be used are as follows:

- Softwoods (coniferous)
- *Araucaria*
  - hoop pine (*Araucaria cunninghamii*)
  - Paraná pine (*Araucaria angustifolia*)
  - monkey puzzle tree (*Araucaria araucana*)
- cedar (*Cedrus*)
- celery-top pine (*Phyllocladus aspleniifolius*)
- cypress (*Chamaecyparis, Cupressus, Taxodium*)
  - Arizona cypress (*Cupressus arizonica*)
  - bald cypress, southern cypress (*Taxodium distichum*)
  - alerce (*Fitzroya cupressoides*)
  - hinoki cypress (*Chamaecyparis obtusa*)
  - Lawson's cypress (*Chamaecyparis lawsoniana*)
  - Mediterranean cypress (*Cupressus sempervirens*)
- Douglas-fir (*Pseudotsuga menziesii*)
  - coast Douglas-fir (*Pseudotsuga menziesii* var. *menziesii*)
  - Rocky Mountain Douglas-fir (*Pseudotsuga menziesii* var. *glauca*)
- European yew (*Taxus baccata*)
- fir (*Abies*)
  - balsam fir (*Abies balsamea*)
  - silver fir (*Abies alba*)
  - noble fir (*Abies procera*)
  - Pacific silver fir (*Abies amabilis*)
- hemlock (*Tsuga*)
  - eastern hemlock (*Tsuga canadensis*)
  - mountain hemlock (*Tsuga mertensiana*)
  - western hemlock (*Tsuga heterophylla*)
- Huon pine, Macquarie pine (*Lagarostrobos franklinii*)
- kauri (New Zealand) (*Agathis australis*)
- Queensland kauri (Australia) (*Agathis robusta*)
- Japanese nutmeg-yew, kaya (*Torreya nucifera*)
- larch (*Larix*)
  - European larch (*Larix decidua*)
  - Japanese larch (*Larix kaempferi*)
  - tamarack (*Larix laricina*)
  - western larch (*Larix occidentalis*)
- pine (*Pinus*)
  - European black pine (*Pinus nigra*)
  - jack pine (*Pinus banksiana*)
  - lodgepole pine (*Pinus contorta*)
  - Monterey pine (*Pinus radiata*)
  - ponderosa pine (*Pinus ponderosa*)
  - red pine (North America) (*Pinus resinosa*)
  - Scots pine, red pine (UK) (*Pinus sylvestris*)
  - white pine
    - eastern white pine (*Pinus strobus*)
    - western white pine (*Pinus monticola*)
    - sugar pine (*Pinus lambertiana*)
  - southern yellow pine
    - loblolly pine (*Pinus taeda*)
    - longleaf pine (*Pinus palustris*)

pitch pine (*Pinus rigida*)
shortleaf pine (*Pinus echinata*)
redcedar
eastern redcedar, (*Juniperus virginiana*)
western redcedar (*Thuja plicata*)
coast redwood (*Sequoia sempervirens*)
rimu (*Dacrydium cupressinum*)
spruce (*Picea*)
Norway spruce (*Picea abies*)
black spruce (*Picea mariana*)
red spruce (*Picea rubens*)
Sitka spruce (*Picea sitchensis*)
white spruce (*Picea glauca*)
sugi (*Cryptomeria japonica*)
whitecedar
northern whitecedar (*Thuja occidentalis*)
Atlantic whitecedar (*Chamaecyparis thyoides*)
Nootka cypress (*Cupressus nootkatensis*)
Hardwoods (angiosperms)
abachi (*Triplochiton scleroxylon*)
African padauk (*Pterocarpus soyauxii*)
afzelia, doussi (*Afzelia africana*)
agba, tola (*Gossweilerodendron balsamiferum*)
alder (*Alnus*)
black alder (*Alnus glutinosa*)
red alder (*Alnus rubra*)
American chestnut (*Castanea dentata*)
ash (*Fraxinus*)
black ash (*Fraxinus nigra*)
blue ash (*Fraxinus quadrangulata*)
common ash (*Fraxinus excelsior*)
green ash (*Fraxinus pennsylvanica*)
Oregon ash (*Fraxinus latifolia*)[1]
pumpkin ash (*Fraxinus profunda*) [1]
white ash (*Fraxinus americana*)
aspen (*Populus*)
bigtooth aspen (*Populus grandidentata*)
European aspen (*Populus tremula*)
quaking aspen (*Populus tremuloides*)
Australian red cedar (*Toona ciliata*)
ayan, movingui (*Distemonanthus benthamianus*)[2]
balsa (*Ochroma pyramidale*)
basswood, linden
American basswood (*Tilia americana*)[1]
white basswood (*Tilia heterophylla*)[1]
beech (*Fagus*)
European beech (*Fagus sylvatica*)
American beech (*Fagus grandifolia*)
birch (*Betula*)
American birches
gray birch (*Betula populifolia*)
black birch (*Betula nigra*)
paper birch (*Betula papyrifera*)
sweet birch (*Betula lenta*)
yellow birch (*Betula alleghaniensis*)
European birches
silver birch (*Betula pendula*)
downy birch (*Betula pubescens*)
blackbean (*Castanospermum australe*)
black tupelo (*Nyssa sylvatica*)
blackwood
Australian blackwood (*Acacia melanoxylon*)
African blackwood, mpingo (*Dalbergia melanoxylon*)
boxelder (*Acer negundo*)
boxwood, common box (*Buxus sempervirens*)
Brazilian walnut (*Ocotea porosa*)
Brazilwood (*Caesalpinia echinata*)
bubinga (*Guibourtia* spp.)[3]
buckeye (*Aesculus*)
horse-chestnut (*Aesculus hippocastanum*)
Ohio buckeye (*Aesculus glabra*)
yellow buckeye (*Aesculus flava*)
butternut (*Juglans cinerea*)
California bay laurel (*Umbellularia californica*)
camphor tree (*Cinnamomum camphora*)
carapa (*Carapa guianensis*)[4]
catalpa, catawba (*Catalpa*)
Ceylon satinwood (*Chloroxylon swietenia*)
cherry (*Prunus*)
black cherry (*Prunus serotina*)
red cherry (*Prunus pensylvanica*)
wild cherry (*Prunus avium*)
Cape chestnut (*Calodendrum capense*)
coachwood (*Ceratopetalum apetalum*)
cocobolo (*Dalbergia retusa*)
corkwood (*Leitneria floridana*)
cottonwood
balsam poplar (*Populus balsamifera*)
eastern cottonwood (*Populus deltoides*)
swamp cottonwood (*Populus heterophylla*)
cucumbertree (*Magnolia acuminata*)
dogwood (*Cornus* spp.)
flowering dogwood (*Cornus florida*)
Pacific dogwood (*Cornus nuttallii*)
ebony (*Diospyros*)
Andaman marblewood (*Diospyros kurzii*)
ebène marbre (*Diospyros melanida*)
African ebony (*Diospyros crassiflora*)[5]
elm
American elm (*Ulmus americana*)
English elm (*Ulmus procera*)
rock elm (*Ulmus thomasii*)
slippery elm, red elm (*Ulmus rubra*)
Wych elm (*Ulmus glabra*)
eucalyptus
Lyptus: flooded gum (*Eucalyptus grandis*)
white mahogany (*Eucalyptus acmenoides*)
brown mallet (*Eucalyptus astringens*)[6]
banglay, southern mahogany (*Eucalyptus botryoides*)
river red gum (*Eucalyptus camaldulensis*)
karri (*Eucalyptus diversicolor*)
blue gum (*Eucalyptus globulus*)
flooded gum, rose gum (*Eucalyptus grandis*)
York gum (*Eucalyptus loxophleba*)[6]
jarrah (*Eucalyptus marginata*)
tallowwood (*Eucalyptus microcorys*)
grey ironbark (*Eucalyptus paniculata*)
blackbutt (*Eucalyptus pilularis*)
mountain ash (*Eucalyptus regnans*)
Australian oak (*Eucalyptus obliqua*)
alpine ash (*Eucalyptus delegatensis*)
red mahogany (*Eucalyptus resinifera*)
swamp mahogany, swamp messmate (*Eucalyptus robusta*)
Sydney blue gum (*Eucalyptus saligna*)
mugga, red ironbark (*Eucalyptus sideroxylon*)
redwood (*Eucalyptus transcontinentalis*)[6]
wandoo (*Eucalyptus wandoo*)[6]
European crabapple (*Malus sylvestris*)
European pear (*Pyrus communis*)
goncalo alves (*Astronium* spp.)
greenheart (*Chlorocardium rodiei*)
grenadilla, mpingo (*Dalbergia melanoxylon*)
guanandi (*Calophyllum brasiliense*)

gum (*Eucalyptus*)
hackberry (*Celtis occidentalis*)
hickory (*Carya*)
  pecan (*Carya illinoinensis*)
  pignut hickory (*Carya glabra*)
  shagbark hickory (*Carya ovata*)
  shellbark hickory (*Carya laciniosa*)
hornbeam (*Carpinus* spp.)
American hophornbeam (*Ostrya virginiana*)
iroko, African teak (*Milicia excelsa*)
ironwood
  balau (*Shorea* spp.)
  American hornbeam (*Carpinus caroliniana*)
  sheoak, Polynesian ironwood (*Casuarina equisetifolia*)
  giant ironwood (*Choricarpia subargentea*)
  diesel tree (*Copaifera langsdorffii*)
  Borneo ironwood (*Eusideroxylon zwageri*)
  Lignum vitae
    guaiacwood (*Guaiacum officinale*)
    holywood (*Guaiacum sanctum*)
  takian (*Hopea odorata*)
  ipê (*Handroanthus* spp.)
  black ironwood (*Krugiodendron ferreum*)
  Lebombo ironwood *Androstachys johnsonii*
  Catalina ironwood (*Lyonothamnus floribundus*)
  Ceylon ironwood (*Mesua ferrea*)
  olive (*Olea* spp.)
  desert ironwood (*Olneya tesota*)
  Persian ironwood (*Parrotia persica*)
  Brazilian ironwood, pau ferro (*Caesalpinia ferrea*)
  yellow lapacho (*Tabebuia serratifolia*)
jacarandá-boca-de-sapo (*Jacaranda brasiliana*)
jacarandá de Brasil (*Dalbergia nigra*)
jatobá (*Hymenaea courbaril*)
kingwood (*Dalbergia cearensis*)
lacewood
  northern silky oak (*Cardwellia sublimis*)
  American sycamore (*Platanus occidentalis*)
  London plane (*Platanus×acerifolia*)
limba (*Terminalia superba*)
locust
  black locust (*Robinia pseudoacacia*)
  honey locust (*Gleditsia triacanthos*)
mahogany
  true mahogany (*Swietenia*)[7]
    West Indies mahogany (*Swietenia mahagoni*)
    bigleaf mahogany (*Swietenia macrophylla*)
    Pacific Coast mahogany (*Swietenia humilis*)
  other mahogany
    African mahogany (*Khaya* spp.)
    Chinese mahogany (*Toona sinensis*)
    Australian red cedar, Indian mahogany (*Toona ciliata*)
    Philippine mahogany (*Toona calantas*)
maple (*Acer*)
  hard maple
    sugar maple (*Acer saccharum*)
    black maple (*Acer nigrum*)
  soft maple
    boxelder (*Acer negundo*)
    red maple (*Acer rubrum*)
    silver maple (*Acer saccharinum*)
  European maple
    sycamore maple (*Acer pseudoplatanus*)
marblewood (*Marmaroxylon racemosum*)
marri, red gum (*Corymbia calophylla*)
meranti (*Shorea* spp.)
merbau, ipil (*Intsia bijuga*)
oak (*Quercus*)
  white oak
    white oak (*Quercus alba*)
    bur oak (*Quercus macrocarpa*)
    post oak (*Quercus stellata*)
    swamp white oak (*Quercus bicolor*)
    southern live oak (*Quercus virginiana*)
    swamp chestnut oak (*Quercus michauxii*)
    chestnut oak (*Quercus prinus*)
    chinkapin oak (*Quercus muhlenbergii*)
    canyon live oak (*Quercus chrysolepis*)
    overcup oak (*Quercus lyrata*)
  English oak (*Quercus robur*)
  red oak
    northern red oak (*Quercus rubra*)
    eastern black oak (*Quercus velutina*)
    laurel oak (*Quercus laurifolia*)
    southern red oak (*Quercus falcata*)
    water oak (*Quercus nigra*)
    willow oak (*Quercus phellos*)
    Nuttall's oak (*Quercus texana*)
okoumé (*Aucoumea klaineana*)
olive (*Olea europaea*)
pink ivory (*Berchemia zeyheri*)
poplar
  balsam poplar (*Populus balsamifera*)
  black poplar (*Populus nigra*)
  hybrid black poplar (*Populus×canadensis*)
  tulip tree (*Liriodendron tulipifera*)
purpleheart (*Peltogyne* spp.)
Queensland maple (*Flindersia brayleyana*)
Queensland walnut (*Endiandra palmerstonii*)
ramin (*Gonystylus* spp.)
redheart, chakté-coc (*Erythroxylon mexicanum*)
śāl (*Shorea robusta*)
sweetgum (*Liquidambar styraciflua*)
sandalwood (*Santalum* spp.)
  Indian sandalwood (*Santalum album*)
sapele (*Entandrophragma cylindricum*)
sassafras (*Sassafras albidum*)
  southern sassafras (*Atherosperma moschatum*)
satiné, satinwood (*Brosimum rubescens*)[8]
silky oak (*Grevillea robusta*)
silver wattle (*Acacia dealbata*)
sourwood (*Oxydendrum arboreum*)
Spanish-cedar (*Cedrela odorata*)
Spanish elm (*Cordia alliodora*)
tamboti (*Spirostachys africana*)
teak (*Tectona grandis*)
Thailand rosewood (*Dalbergia cochinchinensis*)
tupelo (*Nyssa* spp.)
turpentine (*Syncarpia glomulifera*)
walnut (*Juglans*)
  eastern black walnut (*Juglans nigra*)
  common walnut (*Juglans regia*)
wenge (*Millettia laurentii*)
  panga-panga (*Millettia stuhlmannii*)
willow (*Salix*)
  black willow (*Salix nigra*)
  cricket-bat willow (*Salix alba 'Caerulea'*)
  white willow (*Salix alba*)
  weeping willow (*Salix babylonica*)
zingana, African zebrawood (*Microberlinia brazzavillensis*)

In addition to the list of woods currently know, other material are included, like polymers, plastics, stones and precious stones, etc. are contemplated herein, wherein a list of all those materials will not be provided in this specification, as they are commonly found in many reference books, which are herein incorporated by reference for their supportive teachings.

In an additional embodiments of the disclosure, FIGS. 2-5 illustrate a portion of the saxophone 100 showing the positioning of the alternative material brace 122. In particular, in reference to FIG. 3, in this embodiment, the bridge 122 may be removably coupled between the tubes 104 and 108. To attach the removable bridge 122, in one embodiment, there may be an attached coupling mechanism 124, 125, which may be permanently coupled to the saxophone 100, yet designed to removably hold the bridge 122. Each coupling mechanism 124, 125 may be coupled to removable bridge 122 with a bolt through corresponding apertures and/or recesses.

As shown, coupling mechanism 125 may include a slot 130 that forms a first side 134 and a second side 136, and an aperture 132 extending through the first side 134 and the second side 136, wherein the aperture extends through the slot 130. A first end 150 of the bridge 122 may include a first aperture 160, wherein the first end 150 of bridge 122 may slide into slot 130 such that the aperture 132 of the coupling mechanism 125 aligns with the aperture 160 of the first end 150 of bridge 122. A coupling device 154 may then engage the apertures 132 and 160. A second end 152 of bridge 122 may include a second aperture 162 that aligns with a recess 138 of coupling mechanism 124. A coupling device 154 may then engage second aperture 162 and recess 138. In some embodiment, there may be more than one second aperture 162 through second end 152 of bridge 122.

Figure 5:
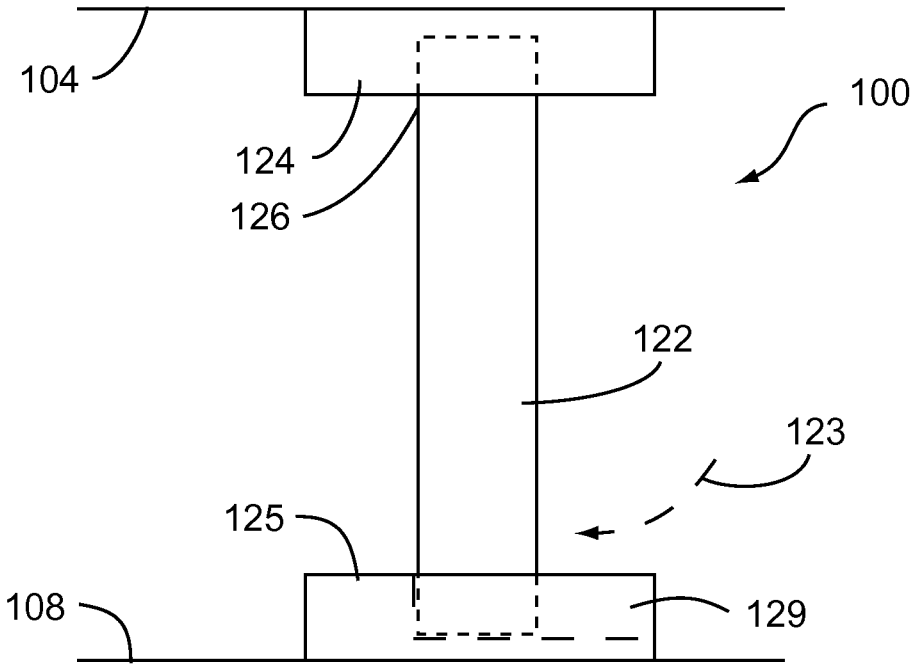
FIG. 5 is diagrammatical view of another embodiment of an instrument with a brace coupled thereto.
Figure 6:
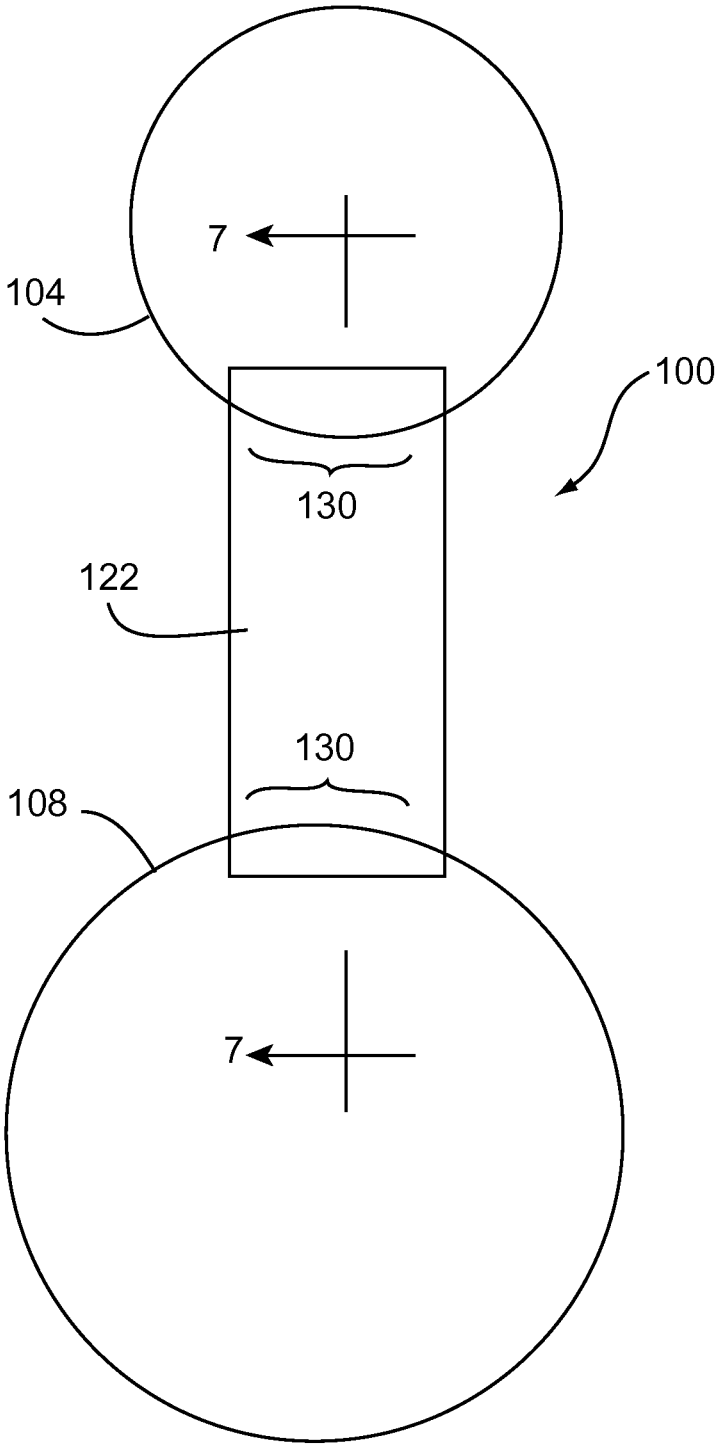
FIG. 6 is a top diagrammatical view of another embodiment of an instrument with a brace coupled thereto.
Figure 7:
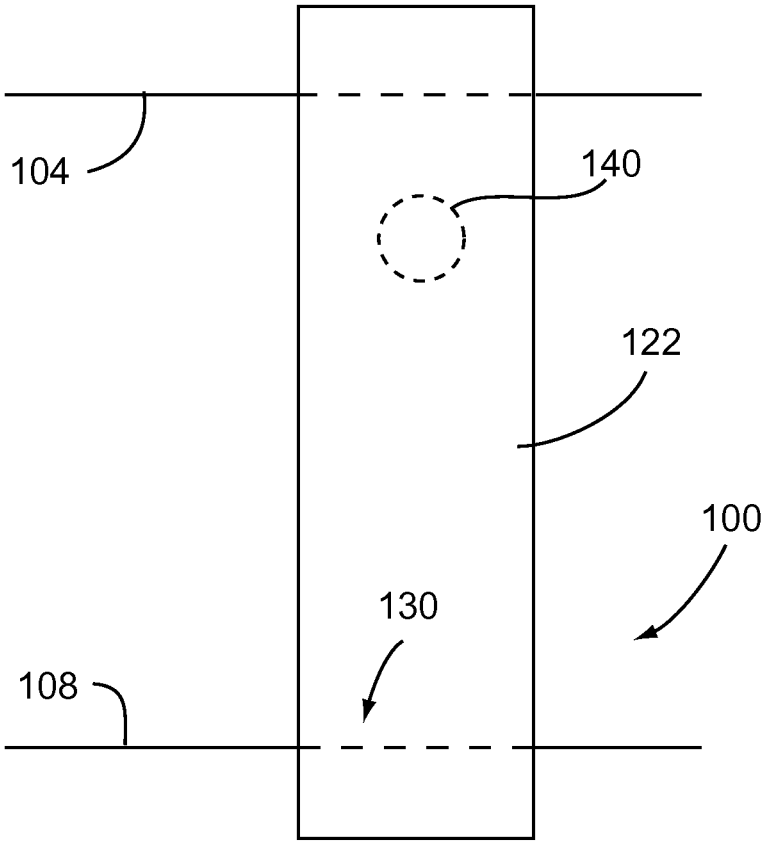
FIG. 7 is a section view of the instrument and brace of FIG. 6 taken along line 7-7.

In another embodiment, depicted in FIGS. 5-7 one coupling 125 may have a slot 129 positioned therein as illustrated, and the second coupling 124 may have a hole 126 positioned therein. Thus, in operation, this design allows for one end of the bridge 122 to be placed in the hole 126, and then allowing the opposite end of the bridge 122 to be rotatively slid 123 along slot 129 in coupling 125 and fit therebetween the two tubes 104 and 108, as illustrated. In this embodiment, the bridge 222 will be slightly longer than the distance between the two couplings 124 surfaces so that there will be a pressure fit therein between. But, any other known retaining system is contemplated in this invention, like a pin inserted through the coupling and end of bridge 222, or a gripping or retaining piece that holds the bridge in place, or any other known retaining system found in the prior art of retaining devices.

Alternatively, there may be only one coupling mechanisms 124 used herein, (not shown) where one coupling 124 is located on only one tube 104, to releasably hold that end of the bridge 122 in place and allowing the other end to also rotatively be placed against the surface of tube 108 and also have a pressure fit design without the use of a coupling mechanism against tube 108, and having a more intimate contact with the surface of the instrument 100.

Referring to FIGS. 6 and 7, there is illustrated an alternative design where the bridge 122 has no coupling mechanism attached to the instrument 100. In particular, the bridge 122 may be pressure fit against the surfaces of the adjacent tubes 104 and 108. It is noted, that there is illustrated a curved surface 130 that may be matched in the bridge 122 to effect a more conformal fit between the bridge 122 and the instrument surface.

In either design, the coupling mechanisms would allow for the removal of a first bridge 122 and replace it with a second bridge (not illustrated), whereby the first and second bridges would be of different material from each other. Specifically, the different materials will provide the instrumentalist to affect or change the tonal qualities created by the different materials and their different harness of material or vibrational transmission qualities. In particular, the qualities know from the different materials would be the harnesses, vibration ability, rigidity, density, and other qualities known by those skilled in the art of wood science.

In an alternative embodiment, the bridge 122 is envisioned in one embodiment to be formed partially hollow 140 and partially solid along its longitudinal length. Wherein, the solid and hollow 140 portions may be located in any region of the bridge 122.

Figure 8:
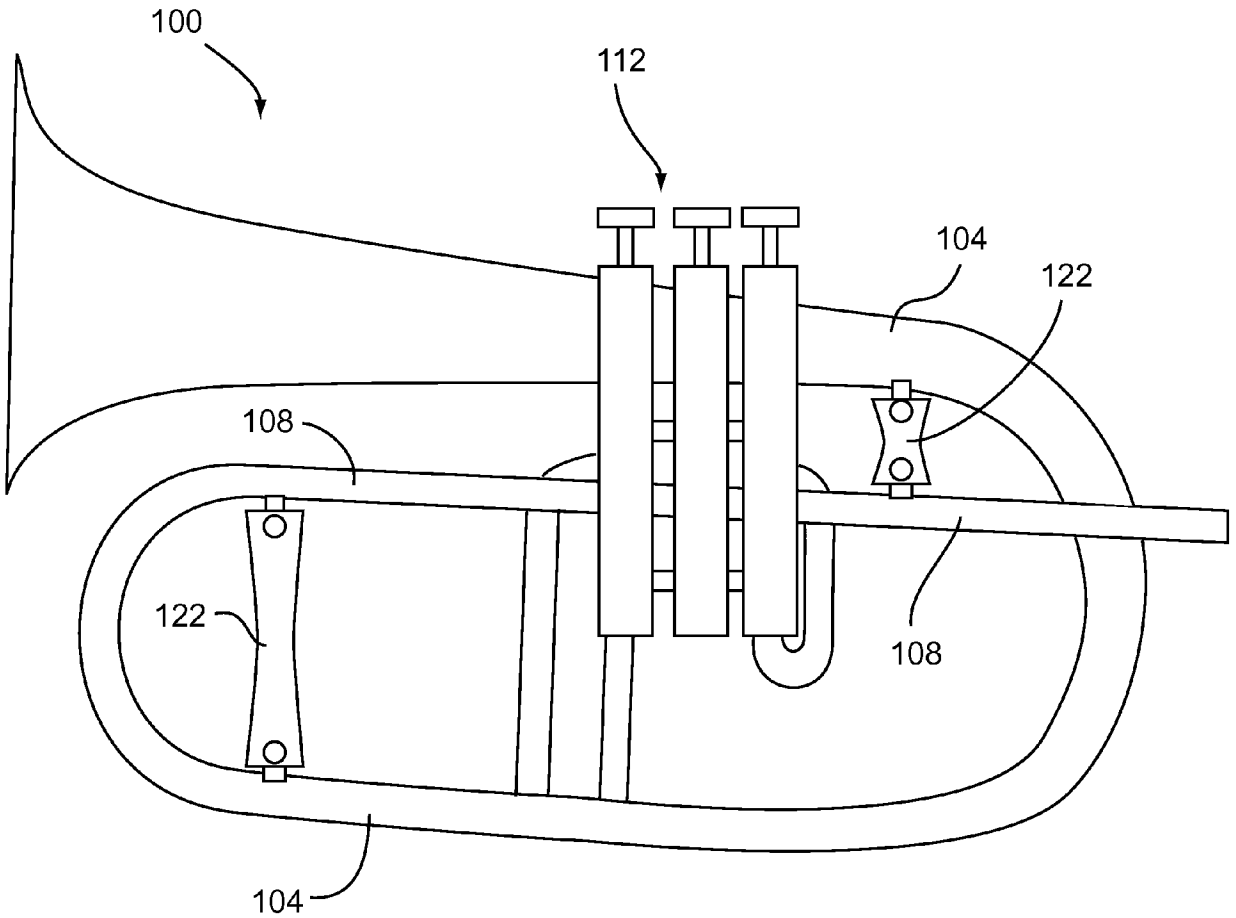
FIG. 8 is a side view of an instrument with two braces coupled between tube portions of the instrument.

Additionally, although a single bridge 122 is illustrated in the wind instrument, it is also contemplated to utilize more than one bridge 122 on the instrument 100. In fact, the use of multiple bridges 122 is common on some instruments 100 like a flugel horn as shown in FIG. 8 that have at least two tubes 104 and 108. Similarly, multiple bridges 122 may be used on other types of instruments, such as, but not limited to, trumpets, trombones, French horns, etc.

It is also contemplated to replace known bridges in their known locations with the new alternative material. It is also contemplated to place additional alternative material based braces 122 in locations not previously taught by the prior art or traditionally known.

It is also contemplated that the dimensions of the bridge does not have to be a single uniform dimension. For example, the bridge 12 may contemplate a straight shape, but may be replaced with most any known shape, including figures of animals, buildings, figurines, artistic designs, or any other crafted shape. Thus, any change of dimension, of any kind—not just diameter, is contemplated.

It is contemplated that any type of material may be used herein, including manmade material, like cement, plaster, ceramic, porcelain, etc. or any other known materials other than those that make up the predominant amount of material that is currently being used in making instruments, like brass and its allows. The main feature of the invention being that the instrument material has a certain vibrational transmission, and the invention contemplates having a material that provides a different vibrational energy transmission quality that affects the produced sounds from that instrument.

It is also contemplated that when an instrument is made of a non-brass material, like silver and the like, the bridge will be made of a non-silver based material. Thus, the invention is not limited to just brass-based instruments, which brass was used as discussion and teaching purposes for the disclosure of the main advantages of the illustrated invention.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A saxophone made of a predominantly first material, comprising:

a mouthpiece, key mechanism, and body defined by at least a body tube, a bell tube, and a bow;

where the body tube and bell tube each have a portion thereof that is spaced apart from each other;

a bridge, having a first and second end that are coupled to the bell tube and body tube respectively, wherein the bridge is made of an alternative material that is different from the predominantly first material;

wherein the first end of the bridge features an aperture;

wherein the bell tube has a first releasably coupling mechanism for releasably coupling the first end of the bridge to the bell tube and for positioning the second end of the bridge against the body tube; and, wherein said first releasable coupling mechanism including a slot that forms a first side and a second side where the first and second sides each have an aperture so that (a) the two apertures of the first and second side align with the aperture of the first end of the bridge when the bridge is inserted into the slot and (b) a coupling device engages the apertures of the first side, the second side, and the bridge when the apertures are aligned.

2. The saxophone of claim 1, wherein:

the second end of the bridge features an aperture;

the bell tube has the first releaseably coupling mechanism and the body tube has a second releasably coupling mechanism for releasably coupling the second end of the bridge to the body tube; and, said second releasable coupling mechanism including a recess so that (a) the aperture of the second end of the bridge can align with the recess when the bridge is inserted into the slot and (b) a coupling device engages the aperture of the second of the bridge when the aperture of the second end of the bridge is aligned with the recess.

3. The saxophone of claim 2, wherein:

the second end of the bridge further features a second aperture; and, said second releasable coupling mechanism includes a second recess so that the second aperture of the second end of the bridge aligns with the second recess is engaged by second coupling device.

4. The saxophone of claim 3, wherein the alternative material consists essentially of a hard wood material selected from the group consisting of Cocbolo, Grenadilla, Maple, Rosewood, and Walnut.

5. The saxophone of claim 3, wherein the alternative material consists essentially of a soft wood material.

6. The saxophone of claim 3, wherein the alternative material consists essentially of a material selected from the group of plastic, polymer, stone, precious stone, fibrous material, porcelain, ceramic, cement, cellulose-based material, and composite material.

7. A method of modifying a saxophone's vibrational energy for certain tones that are created by the saxophone made of a predominantly first material, the method comprising:

obtaining a bridge that has a first and second end;

coupling a bridge between a bell tube and a body tube;

wherein the body tube and bell tube each have a portion thereof that is spaced apart from each other;

wherein the first end and the second end of the bridge are coupled to the bell tube and body tube respectively;

wherein the bridge is made of an alternative material that is different from the predominantly first material;

playing the saxophone to produce a vibrational energy, wherein the vibrational energy is modified by use of the bridge made of an alternative material that is different from the predominately first material;

wherein the first end of the bridge features an aperture;

further comprising using a first releasably coupling mechanism coupled to the bell tube to releasably couple the first end of the bridge to the bell tube and positioning a second end of the bridge against the body tube; and, wherein said first releasable coupling mechanism including a slot that forms a first side and a second side where the first and second sides each have an aperture so that (a) the two apertures of the first and second side align with the aperture of the first end of the bridge when the bridge is inserted into the slot and (b) a coupling device engages the apertures of the first side, the second side, and the bridge when the apertures are aligned.

8. The method claim 7;

wherein the second end of the bridge features an aperture;

further comprising using a second releasably coupling mechanism coupled to the body tube to releasably couple the second end of the bridge to the body tube; and, said second releasable coupling mechanism including a recess so that (a) the aperture of the second end of the bridge can align with the recess when the bridge is inserted into the slot and (b) a coupling device engages the aperture of the second of the bridge when the aperture of the second end of the bridge is aligned with the recess.

9. The method of claim 8, wherein;

the second end of the bridge further features a second aperture; and, said second releasable coupling mechanism includes a second recess so that the second aperture of the second end of the bridge aligns with the second recess is engaged by second coupling device.

10. The method of claim 9, wherein the alternative material of the bridge consists essentially of a hard wood material selected from the group consisting of Cocbolo, Grenadilla, Maple, Rosewood, and Walnut.

11. The method of claim 9, wherein the alternative material of the bridge consists essentially of a soft wood material.

12. The method of claim 9, wherein the alternative material of the bridge consists essentially of a material selected from the group of plastic, polymer, stone, precious stone, fibrous material, porcelain, ceramic, cement, cellulose-based material, and composite material.

* * * * *